United States Patent [19]

Kretschmer

[11] Patent Number: 4,534,308

[45] Date of Patent: Aug. 13, 1985

[54] APPARATUS FOR APPLYING TREATING MEDIA ONTO WEBS

[75] Inventor: Alfred Kretschmer, Ludwigshafen, Fed. Rep. of Germany

[73] Assignee: BASF Aktiengesellschaft, Ludwigshafen, Fed. Rep. of Germany

[21] Appl. No.: 438,276

[22] Filed: Nov. 1, 1982

[30] Foreign Application Priority Data

Nov. 25, 1981 [DE] Fed. Rep. of Germany ..... 3146618

[51] Int. Cl.[3] ..... B05C 1/12

[52] U.S. Cl. ..... 118/260; 118/266

[58] Field of Search ..... 118/260, 264, 266, 267, 118/268, 246; 68/202

[56] References Cited

U.S. PATENT DOCUMENTS

| | | | |
|---|---|---|---|
| 402,188 | 4/1889 | Peregrine | 118/267 X |
| 1,191,134 | 7/1916 | Jones | 118/266 |
| 2,034,209 | 3/1936 | Ritzerfeld | 118/268 X |
| 2,368,648 | 2/1945 | Dulken et al. | 91/38 |
| 2,704,511 | 3/1955 | Malmros et al. | 118/267 X |
| 3,368,522 | 2/1968 | Cordis | 118/260 X |
| 3,496,012 | 2/1970 | Biorseth et al. | 117/111 |
| 3,718,080 | 2/1973 | Yamamoto et al. | 118/260 X |
| 3,827,397 | 8/1974 | Hebberling | 118/50 |
| 4,132,363 | 1/1979 | Kruger et al. | 239/455 |
| 4,176,604 | 12/1979 | Eagen et al. | 118/260 X |

FOREIGN PATENT DOCUMENTS

| | | | |
|---|---|---|---|
| 0050901 | of 0000 | European Pat. Off. | 00000000/FRX |
| 934452 | of 0000 | France . | |

*Primary Examiner*—John P. McIntosh

*Attorney, Agent, or Firm*—Keil & Weinkauf

[57] ABSTRACT

Aqueous treating media are applied onto running webs via a restrictor gap in a hollow body extending over the whole width of the web. A springy strip of material, which regulates and homogenizes the throughput, is clamped, under the force from a spring, between the components defining the gap.

6 Claims, 2 Drawing Figures

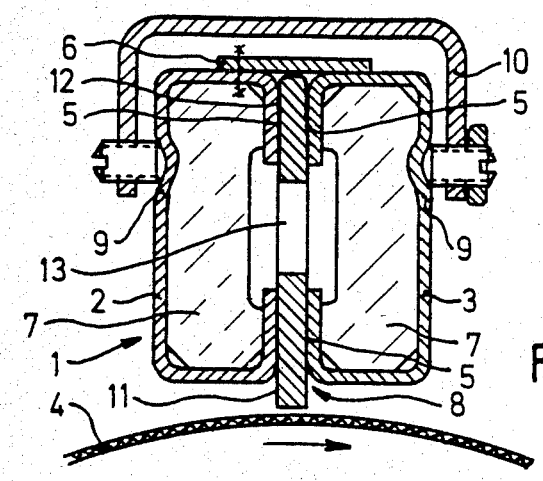
FIG. 1
FIG. 2
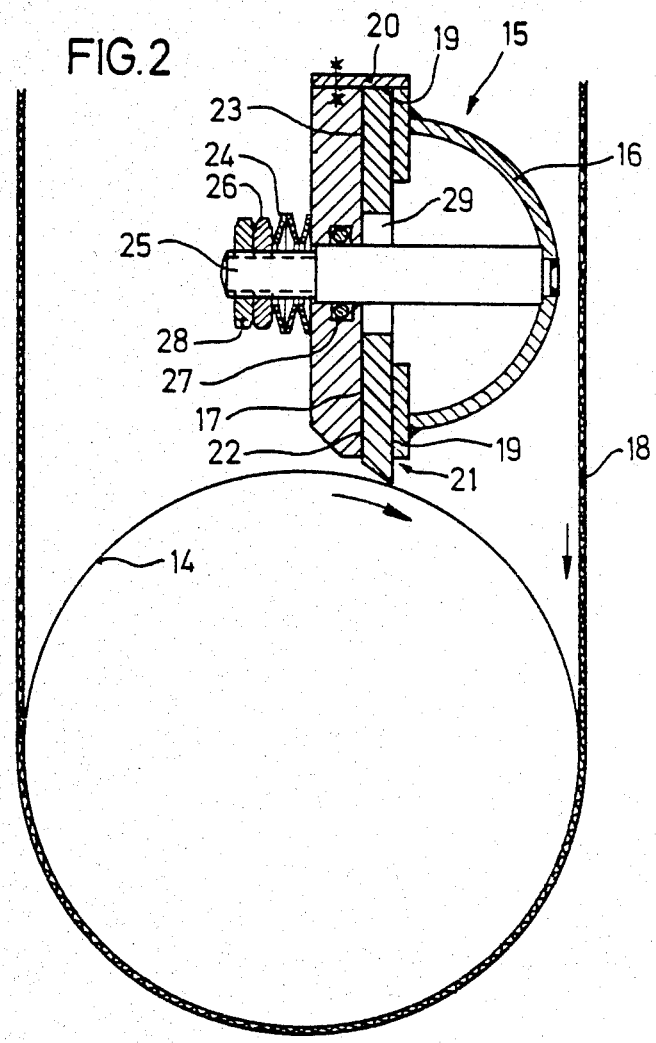

APPARATUS FOR APPLYING TREATING MEDIA ONTO WEBS

The present invention relates to an apparatus for applying aqueous treating media onto running webs, in particular onto textile webs.

An apparatus of this type is preferably used for applying an aqueous treating medium for pre-treating, desizing, washing, dyeing, printing, coating or finishing textile webs which, in the form of open-width woven, knitted, tubular-knitted or tufted goods, or non-wovens or the like, are subjected to the various textile processing treatments.

At relatively high concentrations of the medium, its viscosity can be as much as a thousand times that of water, and it is important that a universal applicator takes this factor into account. In view of the change in viscosity at relatively high treatment temperatures, a further requirement is that the applicator can be employed substantially without regard to the medium temperature. Particularly high requirements are made in respect of uniform application of the medium over the total width of the web, since this substantially determines the uniformity of the effect desired. This applies in particular when the weight of the product being applied is less than the weight of the web being treated, applications of such amounts being advantageous in desizing, bleaching, dyeing, printing, coating and finishing.

Hitherto, the webs to be treated were dipped into one or more troughs which were arranged in series and contained the treating medium. In this method, relatively large amounts of the medium are required to fill the troughs. Continuous renewal of the contents of the trough by means of a feed/overflow arrangement is, in view of the large amounts required for filling as well as the high load for disposal, an approach which is uneconomical and not very satisfactory in respect of pollution of the environment.

Further disadvantages are that the treating medium cannot be applied in a controlled amount using the above equipment, and that, in particular in the case of relatively viscous media, uniform application cannot be achieved by dipping in a series of troughs.

It is an object of the present invention to provide an apparatus by means of which aqueous treating media having a wide range of viscosities can, regardless of the temperature at which the treatment is carried out, be applied uniformly and in controlled amounts onto webs, in particular textile webs. Moreover, the novel apparatus should be economical to operate.

I have found that this object is achieved by an apparatus for applying an aqueous treating medium onto running webs, comprising a hollow body which extends over the width of the webs and has, on the side from which application is effected, a restrictor gap which extends over the same width, wherein the components of the hollow body which define this gap are spring-loaded and movable at right angles to the length of the gap, and, under the force of the spring, clamp a strip of material which regulates the throughput, the apparatus further comprising one or more nozzles for feeding in the medium.

The Examples which follow, and are described with reference to the accompanying drawing, illustrate the novel apparatus and its advantages.

FIG. 1 shows the novel apparatus in cross-section, with a rectangular hollow body.

FIG. 2 shows the novel apparatus in cross-section, with a semicircular hollow body which is closed by a pressure plate.

As shown schematically in FIG. 1, the apparatus essentially consists of a hollow body 1 which is composed of two identical U-shaped sheet metal sections 2 and 3 and its longest dimension extends over the total width of the web 4 to be treated. On their open side, the sheet metal sections are bent at right angles to provide contact surfaces 5 for their connection. For frictional locking of the two sections 2 and 3, a sheet metal connection 6 is welded onto one section (2), the other section (3) making contact with the connection 6. To render the resulting hollow body rigid, the sheet metal sections incorporate reinforcements 7. On the opposite side, the contact surfaces 5 of the sheet metal sections define a restrictor gap 8 parallel to the axis. The sheet metal sections are held together by a plurality of spring bands 10 which are distributed over the length of the hollow body and grip its side walls 9. As a result, the restictor gap is compressed elastically.

Between these contact surfaces, a strip 11, which consists of a resilient material which is permeable to fluids, preferably of a loose mass of fibers, is clamped in the restrictor gap and extends over the total length of the latter.

It is advantageous if the strip is provided with an additional attachment in the hollow body. For this purpose, for example, the strip extends, in its width, over the total cross-section of the hollow body, comes into contact with the sheet metal connection 6 on section 2 and is clamped between the upper contact surfaces 5, the strip being surrounded by a sealing strip 12, for example a plastic film. Openings 13 in the strip 11 provide connections between the two halves of the cavity and promote penetration of the medium into the strip clamped in gap 8.

The hollow body 1, which is closed at each of its two ends with a plate and is provided with an air-release opening, possesses one or more nozzles (not shown in the drawing) for feeding in the medium, these nozzles preferably being located at the end plate. The medium is fed in under pressure, via the cavity, to the restictor gap 8 which is elastically compressed by the spring, so that the width of the gap is adjusted automatically, depending on the pressure, as a result of the elastic mobility of the contact surface 5. Consequently, the effect of the viscosity and the temperature of the medium on the throughput of the latter is substantially compensated by the restrictor gap. In this process, the large surface area and the homogeneous structure of the loose mass of fibers comprising strip 11 have an advantageous effect on the uniformity of the throughput of the medium over the total width of application, and hence on the uniformity of the application. In addition, these factors substantially reduce the effect of fluff in the medium on the throughput of the latter. Furthermore, the large number of commercially available sheet-like, textile structures, substrates and products comprising a loose mass of fibers make it possible to adapt the elastically compressible restrictor gap to the particular requirements which enable the medium to be applied uniformly and in a controlled amount.

The application of a medium onto a web with the aid of the apparatus described above can be carried out either directly or, as illustrated in FIG. 2, via a conventional guide roller 14, or via a special transfer roller, which is engaged by the strip of permeable material and which in turn is engaged by the running web.

A further embodiment of the novel apparatus, which is shown in FIG. 2, comprises a hollow body 15 which is composed of a half-tube 16 closed by a pressure plate 17. To create contact surfaces for clamping the two components, which extend over the total width of the web 18 to be treated, end plates 19 are welded to the two linear edges of the half-tube 16. One of these end plates in turn comes into contact with the sheet metal connection 20 which is joined to the pressure plate 17. The other end plate and the pressure plate together form the restrictor gap 21, in which once again a strip of material 22 is clamped elastically, under the force of a spring. As in the case of the embodiment in FIG. 1, this strip also comes into contact with the sheet metal connection and, surrounded by a sealing strip 23, is clamped. The force on the restrictor gap is produced by a plurality of cup springs 24 distributed over the length of the half-tube, each of the springs being clamped against the pressure plate 17 by a nut 26 screwed on a threaded bolt 25. The threaded bolt is attached to the half-tube 16, and passes through openings 29 in the strip and in the pressure plate, the latter opening being provided with a sealing element 27. The free end of bolt 25, the end which bears the cup spring 24, is provided with a thread for nut 26 and counter-nut 28. The cup spring, in connection with nut 26, permits sensitive adjustment of the elastic contact pressure at the restrictor gap 21.

The hollow body 15 is once again closed by end plates and provided with an air-release opening and one or more nozzles (not shown in the drawing).

The use of the apparatus according to the invention is not limited to the treatment of textile goods which was mentioned at the outset. It can also be advantageously employed for webs composed of paper, plastic, metal or wood, or for other webs, as well as for non-aqueous treating media, for example in coating, in the application of adhesives or in lamination, where the goods to be treated may also be stationary and the applicator may be passed over them, as, for example, in flatbed screen printing.

I claim:

1. Apparatus for the self-regulating application of an aqueous treating medium having a wide range of viscosities, onto a running web, said apparatus comprising a hollow body which contains said medium therein, extends over the width of the web and has, on the side from which the application is effected, a restrictor gap which extends over the same width, and has a strip of permeable material inserted therein throughout the length, taken in the direction of application, of the gap, wherein, in association with said hollow body, there are provided spring means for spring-loaded said hollow body at all times in the direction of the medium-containing interior of said body, and means for mounting said hollow body, including the components thereof which define said gap and have said strip of permeable material inserted therein, to be movable, for a corresponding adjustment of the gap, at right angles to the length of the gap, and, under the force of the spring means compress said strip of material, so that said gap and hence the amount of the throughput are automatically adjusted by the medium pressure acting against the spring means, thereby to automatically compensate for changes in medium pressure in accordance with temperature and hence viscosity variations.

2. Apparatus as claimed in claim 1, wherein the strip of material consists of a loose mass of fibers.

3. Apparatus as claimed in claim 1, wherein the hollow body is composed of two halves which have contact surfaces at which they are clamped together by means of said spring means, and the strip of material, which on the one hand is clamped in the restrictor gap, on the other hand is clamped, with interposition of a sealing strip, by the two halves of the hollow body, at the contact surfaces located opposite, and has openings between these points.

4. Apparatus as claimed in claim 3, wherein the two halves of the hollow body are clamped together by one or more spring bands which are distributed over the length of the hollow body and grip the outsides of the two halves.

5. Apparatus as claimed in claim 3, wherein the spring load applied to connect the two halves of the hollow body is produced by one or more cup springs which are borne by screws which clamp together these two halves.

6. Apparatus as claimed in claim 1, wherein the permeable material in the restrictor gap of the hollow body engages a web guide roller which in turn is engaged by the running web.

* * * * *